US006692424B2

(12) United States Patent
Pasman et al.

(10) Patent No.: US 6,692,424 B2
(45) Date of Patent: Feb. 17, 2004

(54) ROTARY TRIMMER APPARATUS AND METHOD

(75) Inventors: Roman G. Pasman, Des Plaines, IL (US); Macy Langston, Streamwood, IL (US); Peter Harwardt, Joliet, IL (US)

(73) Assignee: Gammerler Corporation, Hanover Park, IL (US)

( * ) Notice: Subject to any disclaimer, the term of this patent is extended or adjusted under 35 U.S.C. 154(b) by 0 days.

(21) Appl. No.: 09/920,526

(22) Filed: Aug. 1, 2001

(65) Prior Publication Data

US 2003/0024424 A1 Feb. 6, 2003

(51) Int. Cl.[7] ..... B41F 13/56

(52) U.S. Cl. ..... 493/324; 493/340; 493/363; 493/365; 83/171; 83/676; 83/698.51; 83/934; 83/698.61

(58) Field of Search ..... 83/698.51, 698.61, 83/170, 171, 168, 676, 665, 934, 501, 502, 504, 498, 499; 493/324, 340, 365, 363, 371

(56) References Cited

U.S. PATENT DOCUMENTS

| | | | | | |
|---|---|---|---|---|---|
| 1,952,281 | A | | 3/1934 | Ranque | |
| 2,755,989 | A | * | 7/1956 | Coward | 415/116 |
| 3,460,418 | A | * | 8/1969 | Mathe et al. | 83/168 |
| 3,886,833 | A | * | 6/1975 | Gunn et al. | 83/499 |
| 3,915,445 | A | * | 10/1975 | Duncan et al. | 270/37 |
| 3,956,957 | A | * | 5/1976 | Corse | 83/482 |
| 4,257,299 | A | * | 3/1981 | Aykut | 83/482 |
| 4,402,559 | A | * | 9/1983 | Shibata et al. | 384/476 |
| 4,474,096 | A | * | 10/1984 | Muller | 83/482 |
| 4,784,030 | A | * | 11/1988 | Waring | 83/105 |
| 5,197,364 | A | * | 3/1993 | Heutschi | 83/29 |
| 5,373,766 | A | * | 12/1994 | Ranly et al. | 83/676 |
| 6,085,624 | A | * | 7/2000 | Lever et al. | 83/13 |
| 6,202,525 | B1 | * | 3/2001 | Hendrickson et al. | 83/16 |

* cited by examiner

*Primary Examiner*—Rinaldi I. Rada
*Assistant Examiner*—Thanh Truong
(74) *Attorney, Agent, or Firm*—Fitch, Even, Tabin & Flannery

(57) ABSTRACT

A rotary trimmer apparatus and signature trimming method are provided that enable operators to set a gap spacing between a rotating knife and an anvil at different predetermined sizes in an easy and accurate manner. The operator chooses the optimum knife/anvil spacing that produces a scissors-like cutting action on the particular type of signatures being trim cut and which does not cause premature knife dulling. The selected knife/anvil spacing is readily reproducable for future runs with the same operating conditions. This is true regardless of changes in the knife thickness as can be created by sharpening thereof, or knife replacement. For this purpose, a user operated control assembly including a control knob and calibrated indexer are provided. To keep the knife/anvil spacing at the set size during trim cutting operations, a temperature control system is employed that keeps axial expansion of the knife spindle shaft from reducing the gap size. In the preferred form, the temperature control system is a cooling system that uses a temperature controlled housing for the spindle shaft that maintains a substantially constant and relatively low operating temperature, e.g. 80° F., therein that is effective to avoid any significant axial shaft growth that would unduly reduce the knife/anvil gap size and cause less than high quality cuts to be generated.

20 Claims, 12 Drawing Sheets

ROTARY TRIMMER APPARATUS AND METHOD

FIELD OF THE INVENTION

The invention relates to an apparatus and method for trimming signatures and, more particularly, to a system for obtaining high quality, precision trim cuts of signatures.

BACKGROUND OF THE INVENTION

Post press signature finishing equipment including such items as folders, rotary trimmers, and various types of stackers, transporters and palletizers are regularly being required to handle greater rates of throughput as printing presses are continually being developed with increasingly fast operating speeds as otherwise high production speeds can be quickly lost post press. For rotary trimmers, this means that the knife needs to be able to maximize the number of cuts, e.g. 15–30 million trims, before requiring maintenance for sharpening or replacement of the cutting surfaces thereof. With high throughputs, trimmers undertake more cuts in a shorter period of time so that if the blade needed maintenance after a relatively few number of cuts there would be unduly frequent downtime for the production line due to the in-line rotary trimmer. This is especially undesirable if the knife starts creating low quality cuts in the middle of a press run requiring interruption of production for knife maintenance.

In rotary trimmers, proper setting of the clearance gap between the rotary knife and anvil is extremely important as that will in large part determine whether the trimmer generates high quality trims over a long knife life. Thus, maximizing knife life is of paramount concern because resharpening the knives is expensive, especially if it goes dull during a press run, as mentioned. Assuming the proper knife/anvil gap is set, they will cooperate with each other to cut or sever edge portions of the signatures with a scissors-like action generating clean, square cut surfaces. However, if this gap is too small or tight, the knife will quickly dull due to the excessive applied force at the cutting edges thereof. As opposed to a scissor-like severing action applied to the signatures, the dulling knife and anvil will exert more of a tearing or ripping action that generates fuzzy cut surfaces. On the other hand, if the gap is too large or loose, then the knife/anvil will not cut at all. Because the difference between a properly set knife and an improperly set knife can be the result of a change in the gap of only thousandths of an inch, setting of the knife/anvil gap needs to be a precise operation.

Currently, rotary knives of trimmers are usually adjusted by very low wage operators whose turnover rate generally is very high. A rough adjustment mechanism is provided to advance the knife toward a lower anvil that is mounted for some vertical overlap with the knife. The operator is supposed to select a feeler gauge with a thickness corresponding to the gap between the blade and anvil needed to generate high quality trim cuts for the particular sheet material to be trimmed. The operator carefully inserts the gauge into the cutting area between the knife and anvil and holds it there with one hand while reaching back with their other free hand to operate the adjustment mechanism for advancing the knife until the gauge is clamped between the knife and anvil. Then, using the adjustment mechanism the operator slightly backs up the knife just enough to allow them to free the gauge.

Of course, at this point the gap is necessarily larger than the gauge thickness so that already it is likely that there will be some quality concerns in cutting with the knife so set. Also, requiring the operator to insert the feeler gauge into the cutting area brings them dangerously close to cutting surfaces on the rotary knives increasing chances for injury. Moreover, as is apparent, this is an arduous procedure that frequently is just not done by low wage operators who instead try to eyeball the adjustment of the knife so that there is the correct gap between it and the anvil.

After this initial set-up, operators are instructed to let the rotary trimmer run for about fifteen minutes, and to then recheck the gap to determine whether the knife/anvil spacing has shifted due to thermal expansion of the knife assembly, and thus if the knife needs to be backed up to maintain the gap at its desired size. However, it has been found that it is very rare for operators to ever undertake this secondary check of the knife/anvil spacing especially since it is inefficient in that it requires the rotary trimming line to be shut down while the rechecking takes place. Since it is the usual case that the knife/anvil gap is not rechecked, it is much more likely that the knife life will be seriously compromised due to thermal expansion.

Directing ambient air into a shroud extending about the knife has been attempted to address the problem of excessive heat at the cutting edges which can cause the ink and varnish at the cut edges to smear and can also cause burning of the cut edges. However, this approach will not be satisfactory in avoiding the reduction in size of the knife/anvil gap during trim cutting operations as heat is also generated at other portions of the knife assembly beyond just at the knife head.

Manufacturers of rotary trimmers and the knives thereof want to be able to market their machines based on how many high quality trims one can expect to obtain before knife maintenance should occur. In this way, their customers can plan for knife maintenance to avoid generating excessive amounts of spoiled product, i.e. signatures with poorly cut surfaces by dull knives. In other words, customers want to be able to plan press runs so they will not be started with a knife that will need to be sharpened or replaced in the middle of the run, which also increases undesirable downtime, as previously discussed.

Certain known variables relating to the paper to be cut such as type, content, weight and thickness, for example, as well as operating speed of the trimmer can be factored in to allow manufactures to determine the knife life a customer can expect. However, the current situation where human operators are required to properly set-up the trimming machine as set forth earlier make such determinations virtually impossible as it has been found that significant inconsistencies in knife life and trim quality arise between different customers that cannot be attributed to differences in the other known variables. Of course, this makes sales of rotary trimmer knifes more difficult as very meaningful statements regarding knife life correlated to the known variables are hard to substantiate. Instead, very large ranges for knife life are specified, e.g. 15–30 million trim cuts, and even so, reaching this range still depends on proper set-up of the machine including the knife/anvil gap spacing.

Accordingly, a need for a rotary trimmer apparatus and signature trimming method exists that provides precision adjustments of the knife/anvil gap to be made in an accurate, easy and efficient manner. Further, a rotary trimmer apparatus and method that allow for high quality trims to be consistently made over long knife lives would be desirable.

SUMMARY OF THE INVENTION

In accordance with the present invention, a rotary trimmer apparatus and signature trimming method are provided that allow the gap spacing between a rotary knife and anvil to be easily and precisely set prior to operation of the apparatus with the knife staying sharp for a maximum number of trims to generate high quality cuts therewith, without the need to recheck the set knife/anvil spacing as previously required. To this end, the present invention allows an operator to incrementally shift the rotary knife to one of the plurality of predetermined spaced positions relative to the anvil without the need for separate special tools or the like. Further, during operation, the knife is maintained at the selected position via a temperature control system for a rotary spindle shaft to which the knife is mounted. The temperature control system maintains the temperature of the rotating shaft substantially constant between its temperature during set-up to its temperature during trim cutting operations. In this manner, axial shifting of the knife due to temperature changes of the shaft, especially thermal expansion of the spindle shaft during cutting operations is substantially obviated, thus keeping the knife at its selected spaced position relative to the anvil ensuring that the knife does not prematurely dull and/or generate less than high quality precision cuts. Accordingly, by way of the present invention, manufacturers of these trimmers and rotary knives will be able to more precisely determine their useful life as a function of various known operating conditions, e.g. paper type, number of folds in the signature books, and operating speeds, as the knife is readily accurately shifted to the desired spaced position relative to the anvil and is maintained thereat, even during high throughput cutting operations of the rotary trimmer, e.g. up to 110,000 signatures per hour.

It has been found that unwanted linear shifting of the knife due to thermal expansion during trimmer operations occurs primarily because of the expansion that occurs at the knife spindle shaft which shifts the knife closer toward the anvil along the shaft axis increasing the forces at the cutting edges of the knife which, in turn, prematurely dulls these edges shortening knife life. Accordingly, the temperature control system herein keeps the temperature of the shaft substantially constant from when the knife/anvil gap spacing is set to its temperature during trim cutting operations. Although the preferred mode of operation is by directing a cooling medium, e.g. cool air, into heat transfer relation with the spindle shaft, it is also contemplated the shaft could be subjected to high heat so that when the knife position is set, the shaft is at a pre-heated high temperature and subsequent heat generation in the shaft bearings will not cause a temperature rise in the shaft. Alternatively, such as where spindle shafts are open as discussed further herein, high volumes of ambient air can be discharged at the shaft so that the shaft does not experience a significant temperature rise during trim cutting operations. The temperature control system herein in whichever form that is employed is effective to keep the shaft at a substantially constant temperature during set-up and trim cutting operations.

Herein, substantially constant temperature of the spindle shaft means the system keeps any temperature differential that develops to a minimum so that any knife shifting due to this differential will be so minor as to not affect the quality of the cuts obtained or be a detriment to the life of the knife. The differential that is acceptable depends on several factors, such as the length of the shaft from where it is held in its forwardmost bearing to the end of the knife and the shaft material, as well as the characteristics of the signature being trim cut.

By way of example and not limitation, to keep shaft expansion to an amount that is not detrimental to trim quality and knife life such as 0.0005 inch and with the spindle shaft being of alloy steel material and having a length of 2.0 inches from bearing to knife end, the temperature differential is preferably kept to approximately 15° F. by the temperature control system herein. The maximum amount of knife shifting that is tolerable is approximately 0.001 inch. In this instance, the temperature differential can be approximately 30° F. To obtain the allowable temperature differential for a particular amount of linear expansion that is tolerable, this amount of linear expansion of the shaft is divided by the product of the operable shaft length, in this instance 2.0 inch, and the coefficient of linear expansion per linear inch, e.g. 0.0000160 in/°F. for an alloy steel knife spindle shaft.

With the preferred cooling of the shaft provided by the present temperature control system, thermal expansion of the knife spindle assembly is minimized thus maximizing the number of trims obtained with the knife that are of a consistently high quality, and avoiding the need to recheck the knife/anvil spacing after running of the trimmer apparatus as was previously required. More particularly, the present preferred cooling system can include a temperature controlled housing or knife spindle block. The spindle block includes a chamber through which the knife spindle shaft extends. Preferably, air is used as the cooling medium and is fed into the knife spindle block, circulates within the internal chamber thereof, and then exits the block to keep the internal space of the housing at a constant, relatively cool operating temperature, e.g. 80° F., at which significant axial shaft expansion will not occur. In this regard, it is preferred that the air be cooled before being fed to the spindle block to below room temperature to improve the cooling capacity of the system.

After exiting the knife spindle block, the cool air can be directed at the periphery of the knife via an adjustable hose with an outlet nozzle that is pointed at the knife edge of the trimming knife such that the cool air impinges thereon. Thus, the present cooling system can cool both the knife spindle and trimming knife simultaneously using a common cool air source. In addition, focusing the cool air directly at the knife cutting edge is much more effective in keeping the heat generation thereat to a minimum versus simply supplying a knife shroud with ambient air flow therethrough. Where the knife is of a solid body design with an integral serrated cutting edge at its periphery versus having a plurality of removable segments, the temperature rise at the cutting edge is more significant, e.g. 170° versus 120°, thus rendering the auxiliary cooling of the knife edge more important in achieving a large number high quality trim cuts therewith. Even with the segmented knife, the auxiliary cooling herein is beneficial in reducing heat build-up at the cutting edges and the low quality product and product spoilage this can create.

As previously mentioned, the present rotary trimmer apparatus allows an operator to very easily and accurately position the knife relative to the anvil. For this purpose, the rotary trimmer apparatus preferably has a control knob that is calibrated for different predetermined spaced positions of the knife relative to the fixed anvil so that turning of the knob indexes the knife between the different positions. This allows an operator to determine which spacing of the knife and anvil generates the best cuts for particular operating conditions and so that when these operating conditions are repeated, they will easily be able to obtain the same knife/anvil spacing and reproduce the high quality cuts they need.

The control knob is remote from the cutting area between the knife and anvil and does not require the use of a feeler gauge or the like so that the operator can remain at the remote position of the control knob during precision setting of the knife position relative to the anvil. Accordingly, no longer is there a need for an operator to get near the cutting area and endanger themselves with the sharp cutting edges of the rotary knife as could previously occur when using the feeler gauge.

For precision shifting of the knife, turning of the control knob rotates a threaded actuator shaft that is operable to translate the spindle block carrying the spindle and knife therewith. An internally threaded member fixed to the spindle block cooperates with the threads on the actuator shaft so that turning of the control knob causes the spindle block to translate on a slide fixture therefor. However, with normal thread tolerances, there will be a backlash after shifting of the spindle block that is unacceptable for the precision movements of the knife needed herein, i.e. on the order of thousandths of an inch. While obtaining precision ground threads is possible, manufacture of these types of threads would undesirably increase the cost of the present trimmer apparatus.

Accordingly, the internally threaded member attached to the spindle block is preferably in the form of a take-up member that is split into opposing portions that are adjustable relative to each other. Thus, the take-up member can be provided with internal threads of a normal tolerance while allowing the portions thereof to be adjusted to take up the slack between the threads of the take-up member portions and the actuator shaft threads while still allowing an operator to rotate the shaft for shifting of the spindle block without seizing. In this manner, the present adjustment mechanism provides precision movements of the spindle block without necessitating the increased cost associated with high precision ground threads. A further advantage of the take-up member is that it can be of a softer material than the actuator shaft, e.g. brass versus steel. Even as the brass take-up member wears, the take-up member portions can be adjusted to accommodate for the extra play in the threads the wear creates thus maintaining the precision movements provided by the present adjustment mechanism over time.

In another aspect of the present invention, a method of maximizing the knife life in a rotary trimmer apparatus is provided. The method includes providing an adjustable rotary knife having at least one peripheral cutting surface and a rotary anvil to form a signature cutting area, adjusting the knife to one of a plurality of predetermined known spacings from the anvil by a user at a position remote from the cutting area, running the signatures through the cutting area and cutting edge portions off therefrom, and keeping thermal expansion of a rotary spindle shaft carrying the rotary knife to a minimum to maintain the knife at the predetermined spacing from the anvil during cutting operations so that the peripheral cutting surface of the knife stays sharp over a maximum number of cuts therewith to generate square cut surfaces of the signatures.

DETAILED DESCRIPTION OF THE PREFERRED EMBODIMENTS

Figure 1:
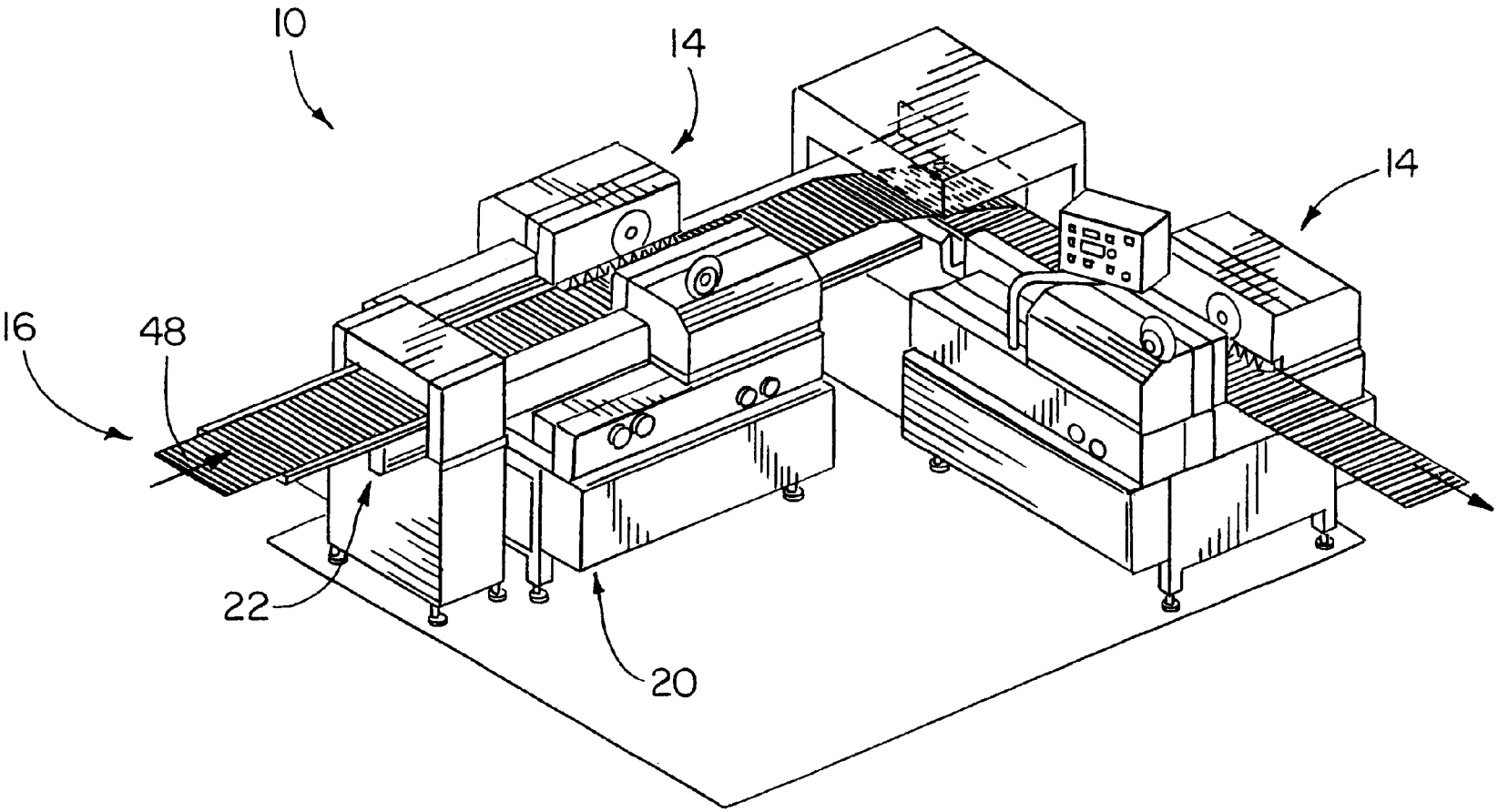
FIG. 1 is a schematic perspective view of a rotary trimmer apparatus including two trimming units for trim cutting of edge portions from signatures conveyed in a shingled stream through the trimming units.

In FIG. 1, a rotary trimmer apparatus 10 for incorporating a signature cutting or trimming apparatus 12 (FIG. 2) in accordance with the present invention is shown. The rotary trimmer apparatus 10 can take on a variety of configurations including the illustrated apparatus 10 having a pair of trimming units 14 that are at a 90° orientation relative to each other so as to allow signatures 16 to have edge portions 18 cut off therefrom that also extend at 90° relative to each other. For transporting the signature 16, the rotary trimmer apparatus 10 has a frame 20 that supports a conveying system 22 on which a stream of signatures 16 is carried downstream. The signatures 16 can be folded and in overlapping orientation with adjacent signatures to provide a shingled stream of the signatures or books 16 that are to be trimmed as they are transported through the trimming units 14.

Figure 2:
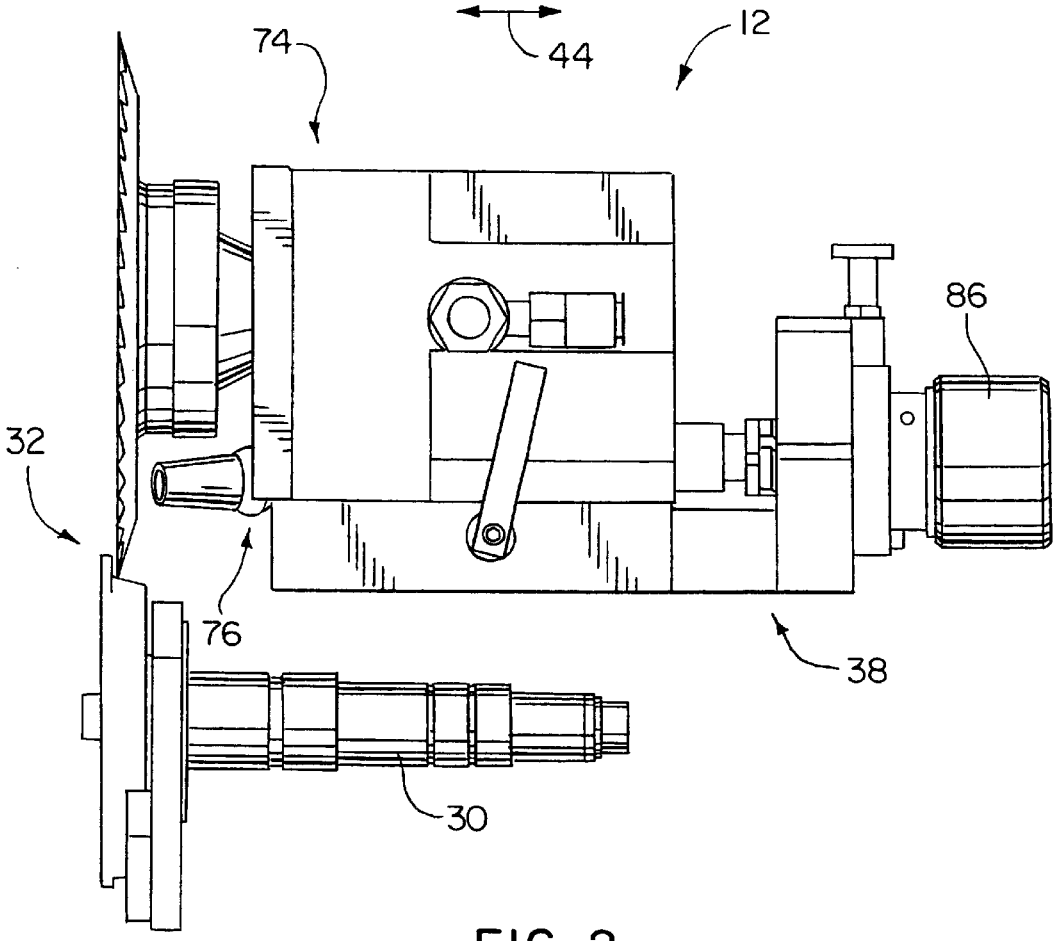
FIG. 2 is an elevational view of a cutting apparatus for the trimming units in accordance with the present invention showing a rotary knife and a lower rotary anvil forming a signature cutting area therebetween and including a cooling system for a spindle shaft mounting the knife and a user operated control assembly for precision indexing of the knife to different spaced positions relative to the anvil.
Figure 3:
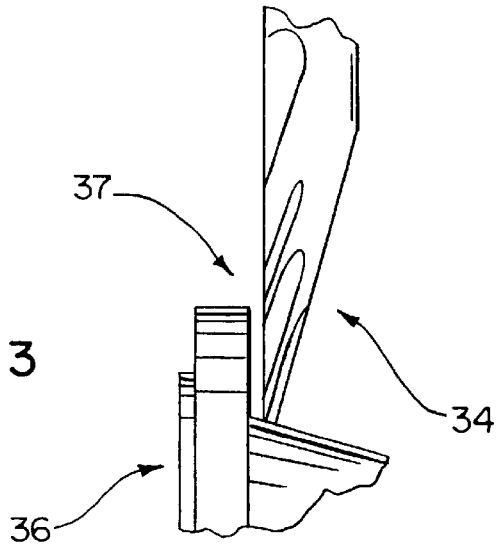
FIG. 3 is an enlarged fragmentary elevational view of the cutting area formed at the overlap between the rotary knife and anvil.

The trimming units 14 each have at least a single set 23 of an upper knife 24 and a lower anvil 26 which are preferable mounted for rotation via respective spindle shafts 28 and 30 therefor. It is also contemplated that the position of the knife 24 and anvil 26 can be substantially reversed so the knife 24 is below the anvil 26. Also, the anvil 26 need not necessarily be rotated; however, for most types of paper and folded books 16, rotation of the anvil 26 generates the best cutting action and thus is desired. As shown in FIG. 1, opposing knife/anvil sets 23 can be provided on either side of the conveyor 22 for trimming of opposite parallel edge portions 18 from the signature books 16. The spindle shafts 28 and 30 are part of a rotary drive system including motors and transmission belting (not shown) that rotate the shafts in opposite directions to cause the knife 24 and anvil 26 to similarly rotate and cut signatures 16 as they pass through a cutting area 32 formed therebetween. In this regard, the knife 24 and anvil 26 overlap each other at their lower end 34 and upper end 36, respectively, with a very small gap 37 therebetween, as best seen in FIGS. 2 and 3.

The spacing of this gap 37 transverse to the travel direction 48 of the signature stream in large part determines the quality of the scissors-like cutting action obtained between the rotating knife 24 and anvil 26, as previously discussed. For this purpose, the present cutting apparatus 12 preferably includes both an adjustment mount, generally designated 38, that allows for precision shifting of the knife 24 to a plurality of predetermined spaced positions relative to the anvil 26 and a temperature control system, generally designated 40 (FIG. 6), that, in the preferred and illustrated form thereof, is operable to keep thermal expansion of the knife spindle shaft 28 to a minimum during cutting operations, although each of the adjustment mount 38 and the temperature control system 40 can be utilized in the cutting apparatus 12 independent of the other and still substantially obtain the advantages for high quality precision trimming that each provides.

One significant cause of problems during trim cutting operations that has been identified herein is heat generation in the knife spindle assembly including the spindle shaft 28, and the temperature differential this creates between the temperature of the material of the shaft as set before cutting operations, and the temperature of the shaft material with the shaft undergoing high rpm's, e.g. 2000, during cutting operations. In prior rotary trimming machines, after the usual rough setting of the knife position relative to the anvil 26 to the desired gap spacing 37 therebetween, the operator needed to go back after running of the machine to make sure a reduction in the size of the gap 37 had not occurred. Any such reduction can prematurely dull the peripheral cutting edge 42 of the knife so that the number of high quality trims generated thereby is not maximized. Herein, the temperature control system 40 is focused on keeping the heat generated at the knife spindle shaft 28 to a minimum.

What has been found is that when there are large forces generated on the knife cutting edge 42, such as when thick signature books 16 are being trimmed or the gap 37 is smaller than it should be, there is greater loading on the knife spindle shaft bearings 43, which, in turn, creates more friction in the bearings and more heat generated on the shaft 28. Heat generation in the spindle shaft 28 causes it to grow in the axial direction 44 along its shaft axis 46 toward the anvil 26 which is transverse to the downstream travel direction 48 of the signature books 16 on the trimmer apparatus conveyor system 22 thus reducing the gap 37. Such thermal expansion of the spindle shaft 28 is believed to account for the majority of the reduction in the knife/anvil gap 37 that occurs during trim cutting operations. As is apparent, the problem of thermal expansion is cumulative and can quickly dull cutting edges 42, especially if sufficient to cause the knife to engage the anvil during trim cutting operations.

Accordingly and has been mentioned, the preferred temperature control system 40 herein is adapted to minimize the thermal expansion of the spindle shaft 28. In the illustrated and preferred form, the temperature control system 40 includes a temperature controlled housing 48 having an internal cavity or space 50 in which the shaft 28 extends and into which cooling medium can be directed into heat transfer relation with the knife shaft 28 to keep it from thermally expanding and changing the gap spacing 37 between the knife 24 and anvil 26 during trimming operations. Alternatively, where the spindle shaft 28 is not disposed in a housing 48, the cooling medium can be simply discharged directly at the open shaft 28. While the cooling medium can be air that is cooled below ambient as described more fully hereinafter, it is also possible for this medium to simply be ambient air, of course recognizing that this would necessitate higher rates and volumes of such air discharged into heat transfer relation with the shaft versus those required for cooled air.

Figure 6:
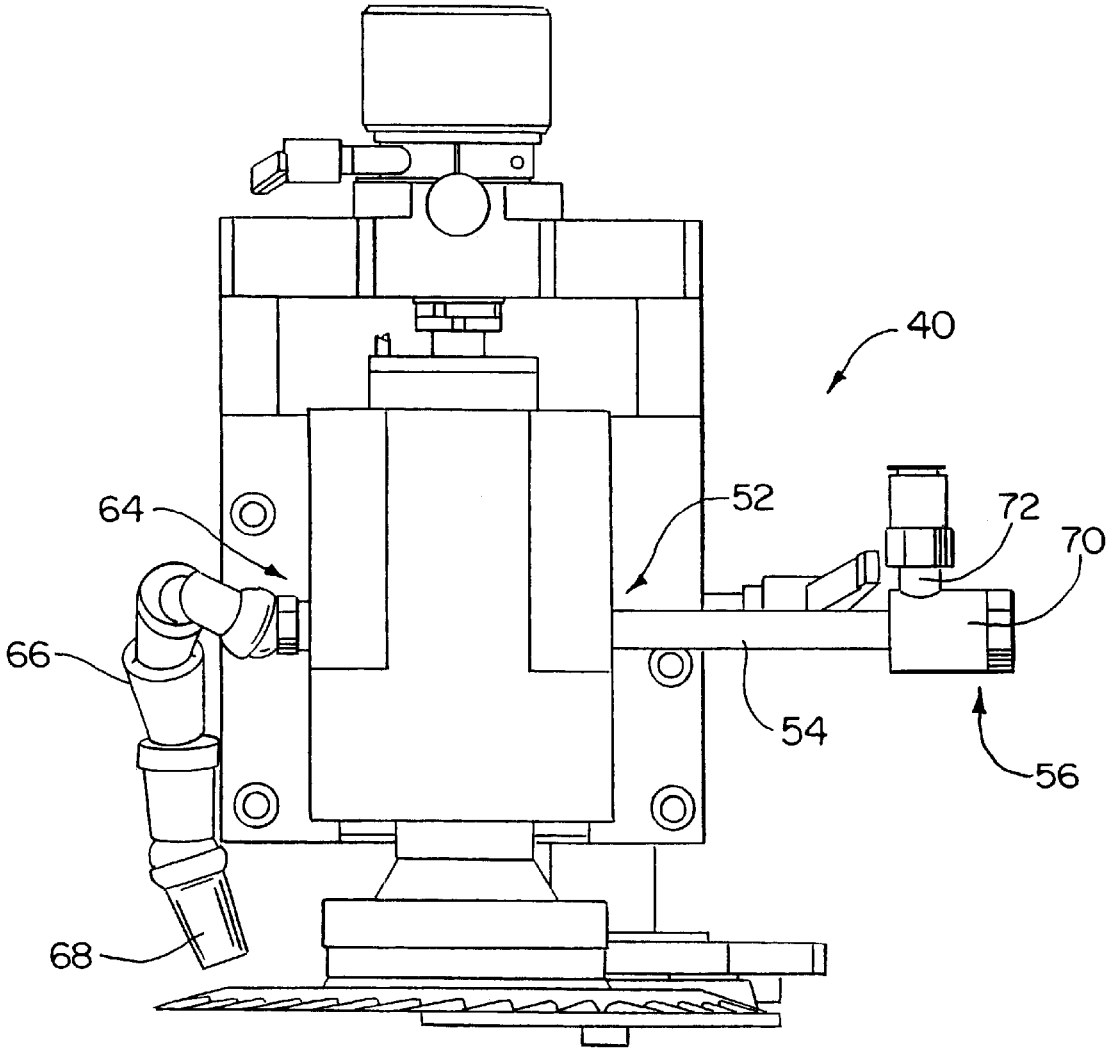
FIG. 6 is a plan view of the cutting apparatus of FIG. 2 showing a control knob for turning an actuator shaft of the control assembly, a take-up member on the actuator shaft attached to a spindle block, a cool air source of the knife spindle cooling system that supplies cool air to the spindle block and an auxiliary cooling line that directs cool air at the knife peripheral cutting edge.

More particularly, the housing 48 can be a spindle block similar to prior spindle blocks modified to including porting 52 for a cooling medium supply line 54, as shown in FIG. 6. The supply line 54 directs cooling medium from a source 56 therefor into the housing internal space 50. The present temperature control system 40 preferably uses air as the cooling medium with the air also having preferably been reduced to a temperature below ambient temperature, e.g. approximately 50° F. Air as the cooling medium is preferred due to its low cost, ready availability and environmental friendliness. With cool air being supplied into the spindle block housing space 50, the temperature of the spindle shaft 28 can be kept substantially stable during trim cutting operations such as at a constant 80° F., for example, at which temperature the shaft 28 will undergo little, if any, thermal expansion along its axis 46 that would negatively affect the knife/anvil gap spacing 37 in terms of obtaining high quality cuts therewith, as previously has been described.

Figure 4:
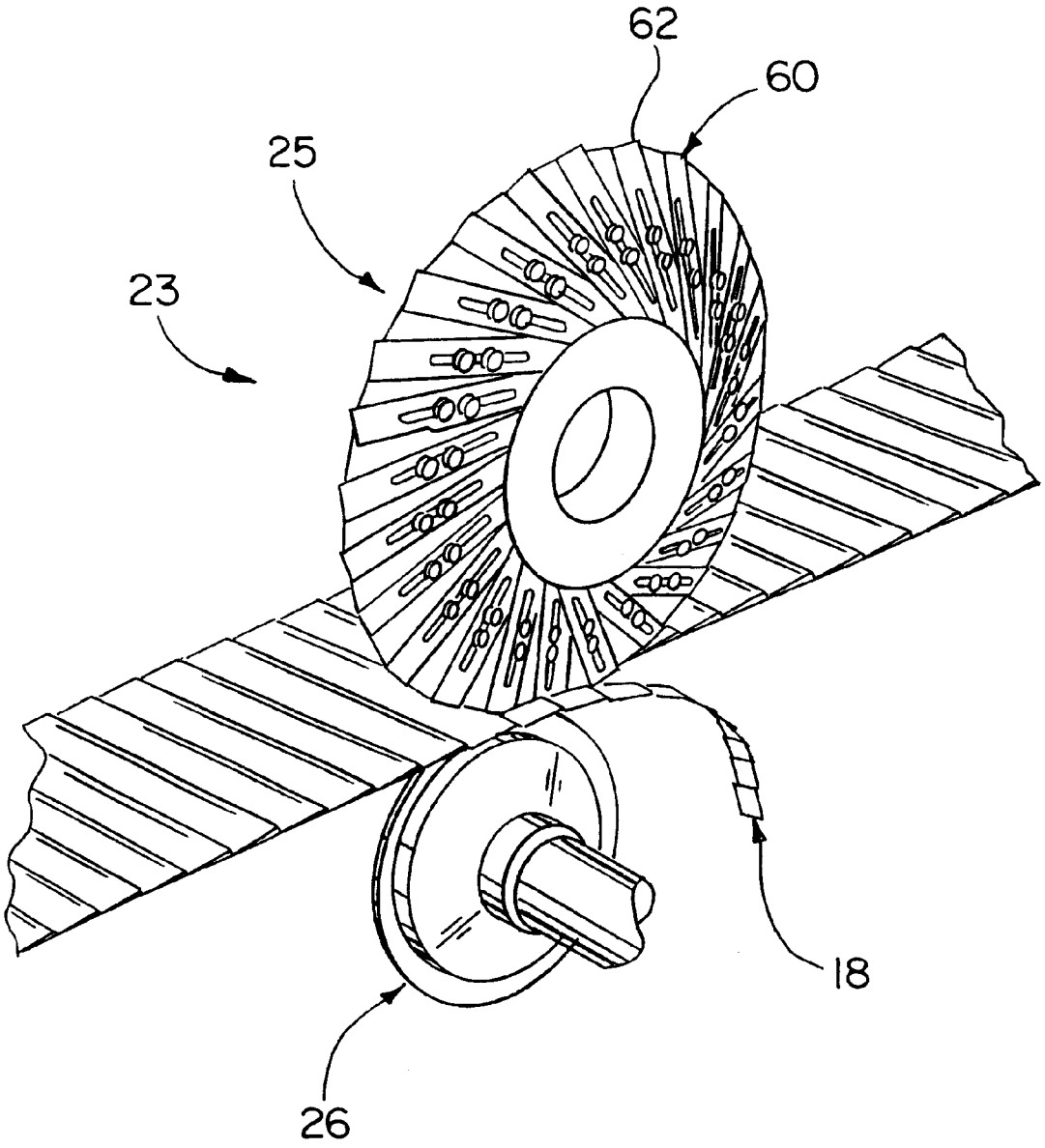
FIG. 4 is a perspective view of the rotary knife and anvil during operation of the rotary trimmer apparatus showing edge portions of the shingled signatures being severed and the knife including a plurality of removably attached cutting segments.
Figure 5:
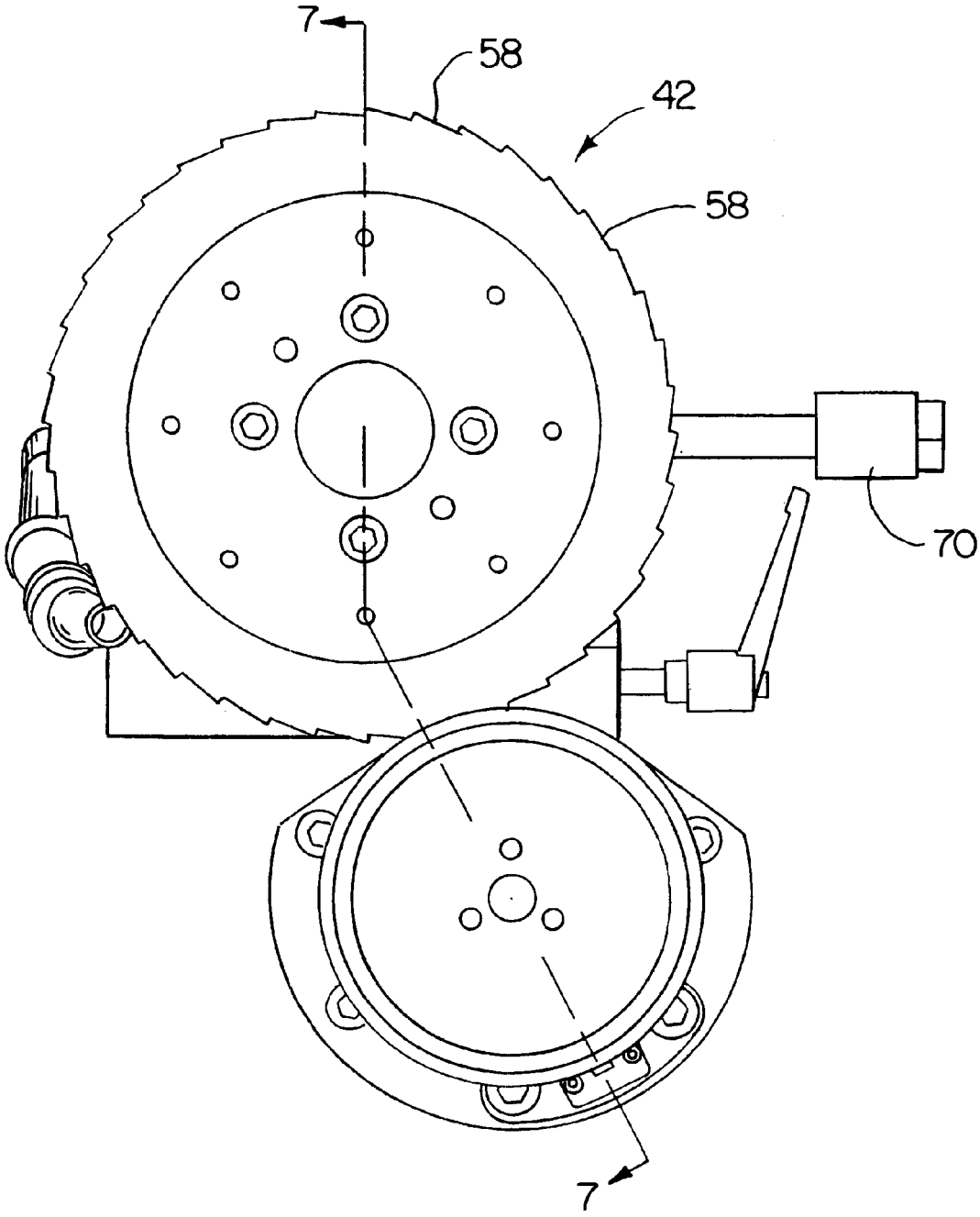
FIG. 5 is a front elevational view of the rotary knife and anvil as shown in FIG. 2. showing a solid body knife having a serrated peripheral cutting edge.

In the preferred and illustrated form, the temperature control system 40 also provides for cooling of the rotary knife 24 that is focused at the area where it is needed most; that is, the temperature control system 40 also directs cool air at the knife peripheral knife cutting edge 42. This is of particular importance where the knife 24 is of a solid body design such as shown in FIG. 5 with the cutting edge 42 being serrated to form a large number of cutting teeth 58 integral with the knife body and extending around the periphery thereof. With these type of solid body knives versus the knives 25 shown in FIG. 4 that have a plurality of segments 60 each with a cutting edge 62 thereof, as described in applicant's assignees U.S. Pat. No. 4,840,098, there is a significant difference in the temperature rise that occurs during cutting operations. The segments 60 are of a very hard material such as a tungsten carbide material. With solid body knives 24, the temperature can reach approximately 180° F. during trim cutting operations while with the segmented knife 25 operating temperatures reach only approximately 120° F. It is believed that this is primarily due to the increase in the amount of cutting edge surfaces provided with the serrated cutting edge 42 of the solid body knife 24 versus the cutting edges 62 of the segmented knife 25 and the lack of heat dissipating surfaces on the solid body knife 24 as compared to those provided by the segments 60 of the knife 25.

Accordingly, the spindle block housing 48 is also ported at 64 to provide an outlet for the cool air fed to the internal cavity 50 via supply line 54. At the outlet port 64, a flexible air line or hose 66 is attached, as best seen in FIG. 6. The line 66 includes an outlet nozzle 68 with the line being flexible yet capable of retaining its flexed orientation so as to allow an operator to manipulate the line 66 to orient the nozzle 68 for directing cool air taken from the housing internal space 50 toward the knife serrated cutting edge 42. In this way, the temperature control system 40 keeps the heat generated at the cutting edge 42 during trim cutting operations to a minimum.

For generating cool air, the source 56 can include a vortex tube 70 utilizing technology similar to that disclosed in U.S. Pat. No. 1,952,281, which is incorporated by reference herein. Utilizing a vortex tube 70 allows a feed line 72 to be attached to a shop air source for utilizing pressurized ambient temperature air, e.g. 90 psi in the range of approximately 50–70° F., with the tube 70 creating two streams of air therein including a hotter outer stream that is vented and a cooler inner stream that is fed to the supply line 54 for being directed into the spindle block housing internal space 50. As is apparent, the vortex tube 70 provides an inexpensive way for the present temperature control system 40 to provide the spindle block housing 48 with cool air.

Figure 9:
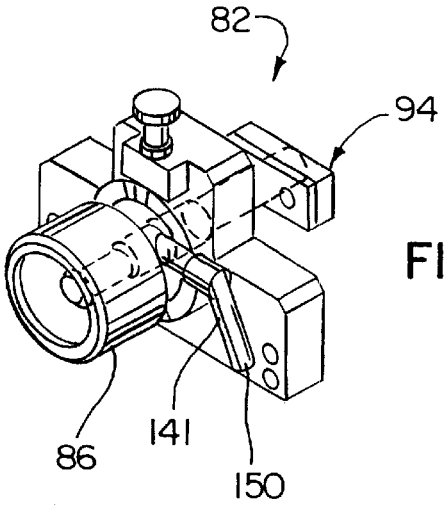
FIG. 9 is a perspective view of the user operated control assembly including the control knob, the plunger and apertured collar, and the take-up member on the actuator shaft.
Figure 10:
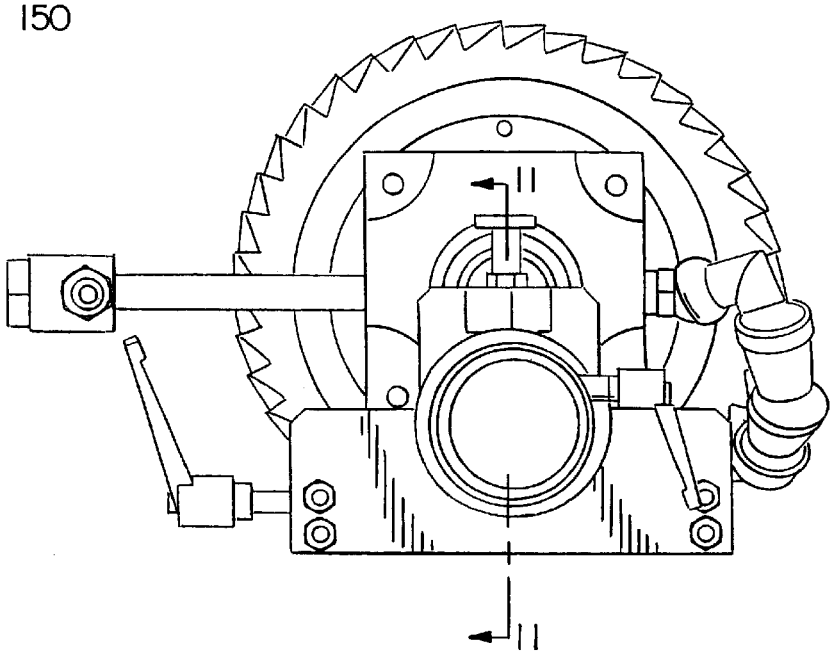
FIG. 10 is a rear elevational view of the cutting apparatus showing a releasable lock in the form of screw clamps having lever operating arms for the apertured collar and the slide block.
Figure 11:
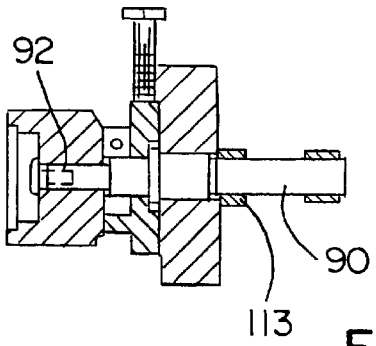
FIG. 11 is a cross-sectional view taken along line 11—11 of FIG. 10 showing the control knob, the plunger and apertured collar, and the take-up member on the actuator shaft.

Turning next to the precision adjustment mount 38, reference will be initially had to FIGS. 9–11 which show a user operated control assembly, generally designated 82, thereof. Similar to the temperature control system 40 that was retrofittable to prior rotary trimmer machines having a spindle block, the control assembly 82 can be retrofit by attaching it to the spindle block housing 48, as will be described more fully hereinafter. The user operated control assembly 82 allows an operator to precisely control the position to which they shift the knife 24 relative to the anvil 26 so that the gap spacing 37 therebetween is known to the operator. As this control assembly 82 is mounted at the rear end portion 84 of the spindle shaft housing 48 and the operator need only turn a control knob 86 and utilize an indexing mechanism 88 adjacent the knob 86 to effect incremental shifting of the knife 24 to form predetermined known gap spacings 37 with the anvil 26, the operator will be at a position remote from the cutting area 32 when adjusting the position of the knife 24 with the present user operated control assembly 82. In this way, the control assembly 82 herein substantially obviates the safety concerns posed by the prior adjustment techniques that require an operator to insert a gauge in the cutting area 32, as previously described.

More specifically, the control knob 86 operates a screw drive system 89 for the spindle block 48 by way of its attachment to an actuator shaft 90 as by fastener 92 at one end of the shaft 90 so that turning of the control knob 86 causes the actuator shaft 90 to rotate. At its opposite end, the actuator shaft 90 threadably drives the spindle block 48 for translation via internally threaded member 94 secured to the rear end portion 84 of the spindle block housing 48. For this purpose, the member 94 includes a pair of fastener receiving through holes 96 and 98 on either side of internally threaded bore 100 with the apertures 96 and 98 aligned with corresponding threaded apertures (not shown) in the spindle block rear end 84 and the bore 100 aligned with a recessed bore 102 in the spindle block rear end portion 84.

Figure 7:
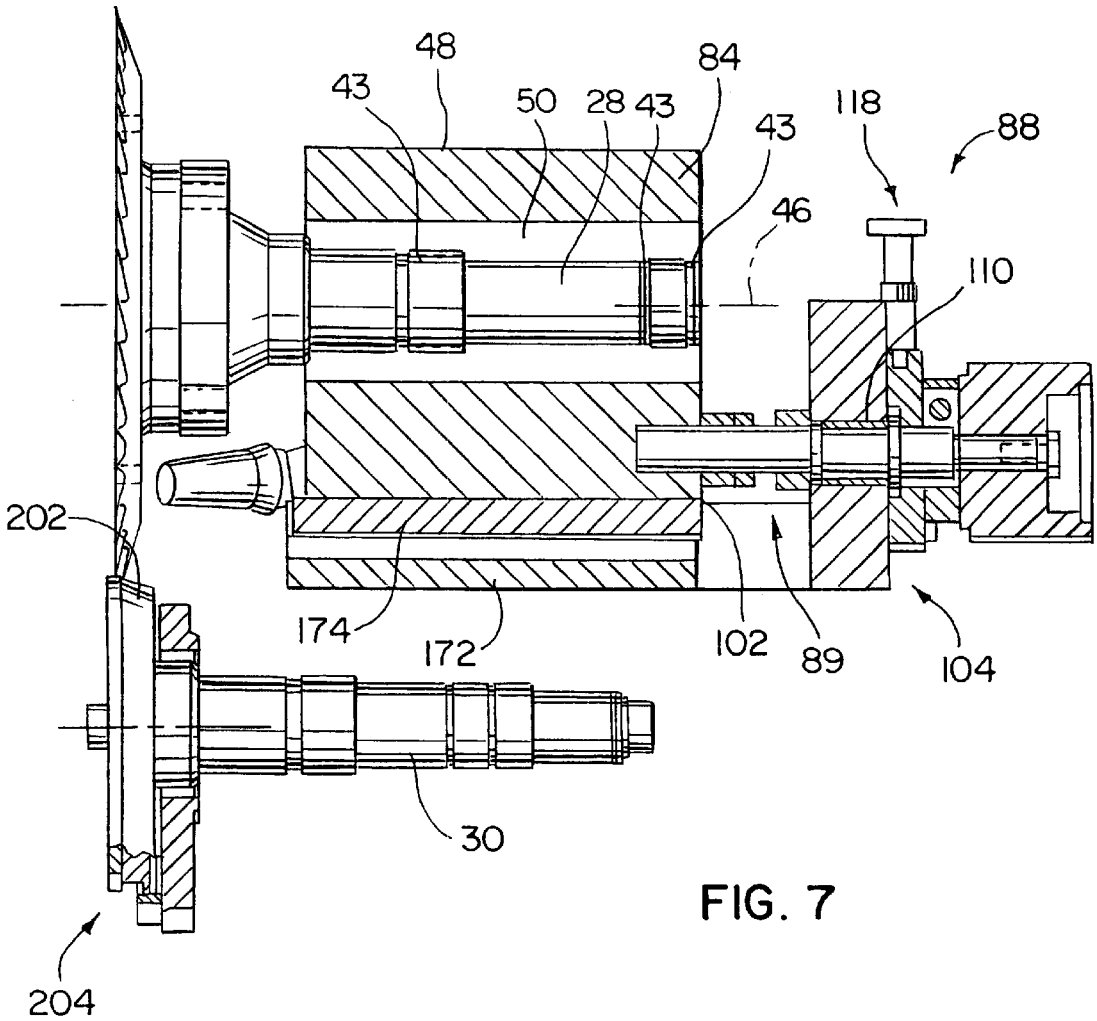
FIG. 7 is a cross-sectional view of the cutting apparatus taken along line 7—7 of FIG. 5 showing an internal space in the spindle block housing in which the knife spindle extends and an indexing mechanism including a plunger and apertured collar that are calibrated to cooperate to identify the different predetermined spaced positions of the knife relative to the anvil obtained by turning the control knob.
Figure 16:
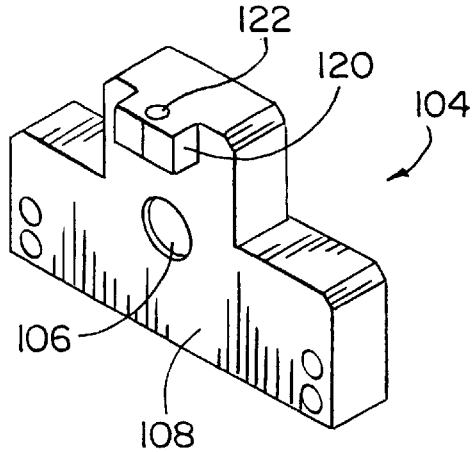
FIG. 16 is a perspective view of a mounting plate for the user operated control assembly.

As mentioned, the control assembly 82 includes an adjacent indexing mechanism 88 that is disposed between the control knob 86 and a support plate 104 for the actuator shaft 90, as can be seen in FIG. 7. The plate 104 rotatably supports the actuator shaft 90 extending through a central bore 106 formed in vertical wall portion 108 thereof, as shown in FIG. 16. A bushing 110 is press-fit in the vertical wall portion bore 106 for rotatable supporting the actuator shaft 90.

Continuing reference to FIG. 7, the indexing mechanism 88 includes an indexing collar 112 that is mounted on the actuator shaft 90 between the control knob 86 and the support vertical wall portion 108. A retainer member 113 is mounted at a predetermined axial position along the shaft 90 behind the wall portion 108 to capture the collar 112 between the support plate 104 and knob 86 against axial shifting on the shaft 90.

Figure 17A:
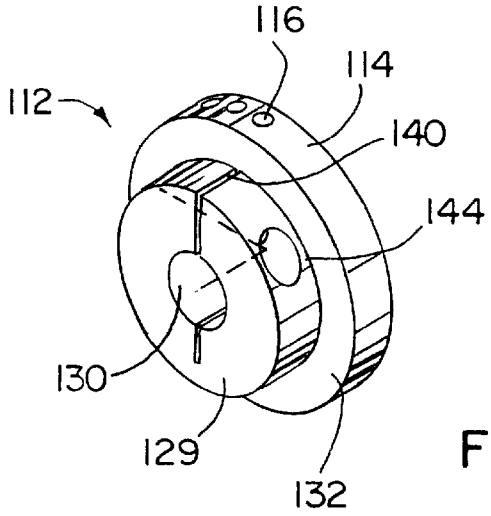
FIG. 17A is a perspective view of the apertured collar.
Figure 17B:
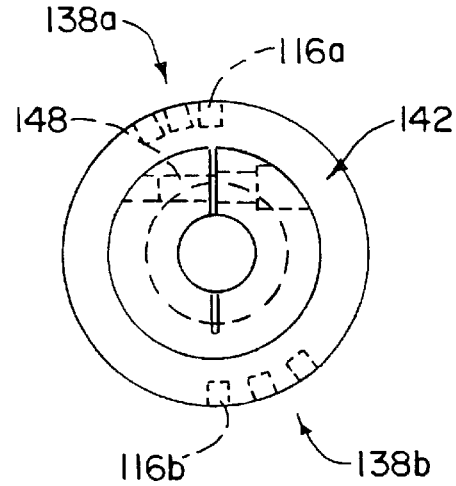
FIG. 17B is a front elevational view of the collar of FIG. 17A showing two sets of apertures thereof.

As best seen in FIGS. 17A and 17B, the collar 112 includes a large diameter portion 114 having calibrated apertures 116 formed therein. These apertures 116 cooperate with a plunger assembly 118 so that a user has an indication of when they have reached a certain predetermined spacing 37 of the knife 24 from the anvil 26.

Figure 12:
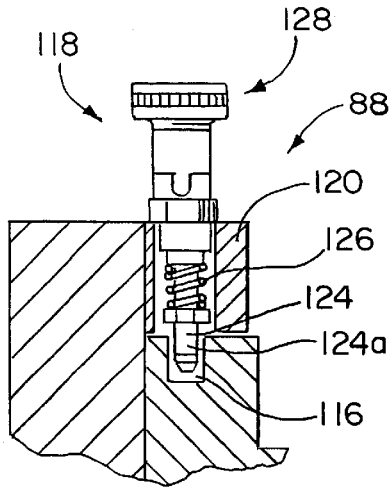
FIG. 12 is an enlarged fragmentary view partially in section of the plunger and apertured collar.
Figure 13:
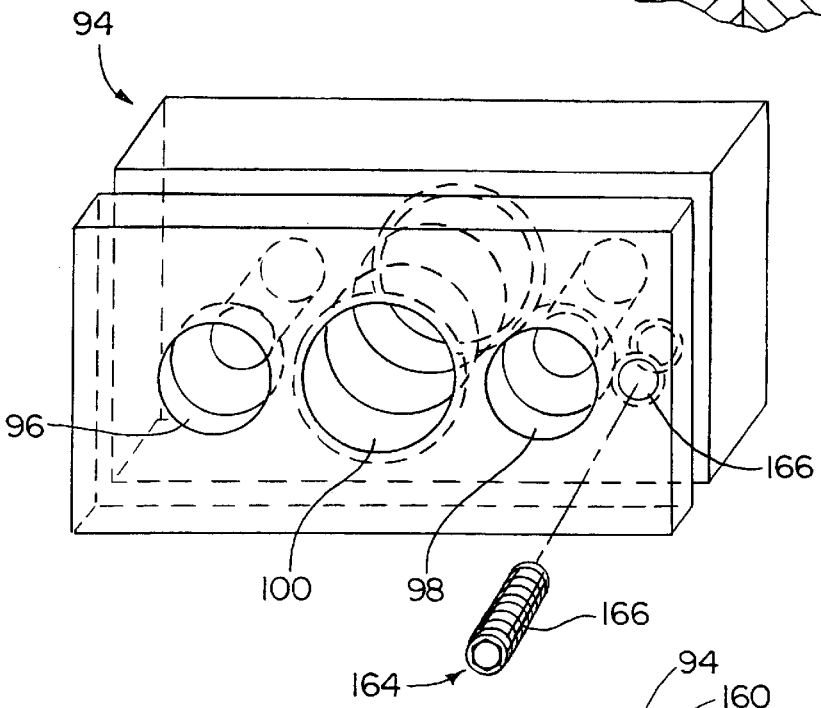
FIG. 13 is an enlarged perspective view of the take-up member showing opposing portions thereof and an adjustment member therefor.

More particularly, the support plate 104 includes an upper rearwardly extending overhang portion 120 to which the plunger assembly 118 is mounted. The upper overhang portion is situated above the indexing collar 112, and particularly apertured portion 114 thereof, and has a vertical through aperture 122 in which plunger shaft 124 is biased downwardly by spring member 126, as best seen in FIG. 12. Accordingly, when the indexing collar 112 is rotated such that one of the apertures 116 is brought into alignment with the through aperture 122, the plunger shaft 124 will be biased so that its lower end 124*a* projects into the aligned aperture 116 to arrest further turning of the collar 112, and in this way the operator will know that they are at the indicated spaced position 37 for the knife 24 and anvil 26, as discussed further hereinafter. If the operator wants to continue to shift the knife 24 relative to the anvil 26, they pull on upper knob 128 of the plunger assembly 118 so that the plunger shaft lower end 124*a* clears the aligned aperture 116 allowing the collar 112 along with the actuator shaft 90 to be turned.

The indexing collar 112 is also provided with an integral smaller diameter portion 129 with both the portions 114 and 129 having aligned central through openings to define a through bore 130 for the collar 112 through which the actuator shaft 90 extends. The collar 112 is oriented on the shaft 90 so that the small diameter portion 129 projects rearwardly and is disposed between the control knob 86 and the large diameter portion 114. Accordingly, there is an annular surface 132 on the large diameter portion 114 that faces the operator as they are turning the control knob 86. To this annular surface 132, a ring label member 134 is adhered. The label member 134 can have a self-adhesive backing thereon and is provided with indicia 136 that when adhered to the annular surface 132 are aligned with the apertures 116 to allow an operator to read at which knife/anvil gap spacing 37 they are set. As shown, there are two sets 138*a* and 138*b* of apertures 116 with the aperture set 138*a* being adapted for a fine knife/anvil spacing size adjustments and the aperture set 138*b* adapted for coarser knife/anvil spacing size adjustments.

By having a number of different predetermined knife/anvil spacings 37 that an operator can select, the operator has significant flexibility in choosing the spacing 37 that provides the highest quality of cuts given the type of signatures 16, e.g. paperweight, thickness, number of folds, etc., being run and the anticipated operating speed of the trimmer apparatus 10. In addition, the operator can either make fine or course adjustments of the spacing 37. By way of example and not limitation, the apertures 116 of the aperture set 138*a* can be calibrated so that shifting of the knife 24 is at increments of 0.0015 inch, while the apertures 116 of the set 138*b* can be calibrated so that shifting of the knife 24 is at increments of 0.002 inch. For this purpose, the apertures 116 of aperture set 138*a* are angularly spaced at 13.5° intervals from each other, and the apertures 116 of the set 138*b* are angularly spaced at 18° from each other.

For setting of the knife/anvil spacing 37 utilizing the control assembly 82, the zero position of the knife/anvil set 23 needs to be initially set. In other words, the position at which the knife 24 is in engagement with the anvil 26 is to be the starting point for making the predetermined incremental adjustments to the spacing 37. To do this, the collar 112 is allowed to rotate relative to the actuator shaft 90 by the provision of a narrow slot 140 in the small diameter portion 129 of the collar 112 that extends normal to the bore 130. The slot 140 does not extend all the way through the entire diameter of the portion 129. As can be seen best in FIG. 17A, the slot space 140 is very narrow, and increases the diameter of the bore 130 just enough to allow it to be in a clearance fit with the actuator shaft 90 extending therethrough. This allows an operator to turn the collar 112 on the shaft 90 until the zero position aperture 116*a* in aperture set 138*a* or aperture 116*b* in aperture set 138*b* is aligned with the plunger shaft 124 for receipt thereof. The control knob 86 is then turned with the collar 112 held against rotation by the plunger shaft 124 to advance the knife 24 into engagement with the anvil 26.

By first setting the zero position of the collar 112 before operation of the control knob 86, unintended rotation of the shaft 90 by turning of the collar 112 as by its frictional engagement with the shaft 90 will not occur. This ensures that the knife 24 will stay engaged with the anvil 26 during the zero position setting operation. Also, this zero position setting procedure where the shaft 90 is rotated with the collar 112 held in place, renders thickness changes in the knife 24 such as due to sharpening or use of different types or styles of knives irrelevant. Whatever the knife thickness may be, the knife 24 will be in engagement with the anvil 26 at the zero set position and from which the incremental adjustments to the knife/anvil gap spacing 37 will be made, as described further below.

Figure 19:
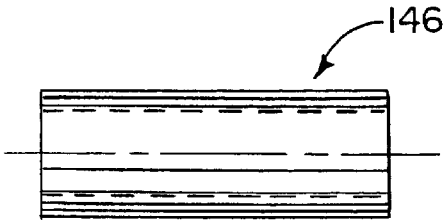
FIG. 19 is a side-elevational view of a spacer member for the releasable lock of the collar member.
Figure 20A:
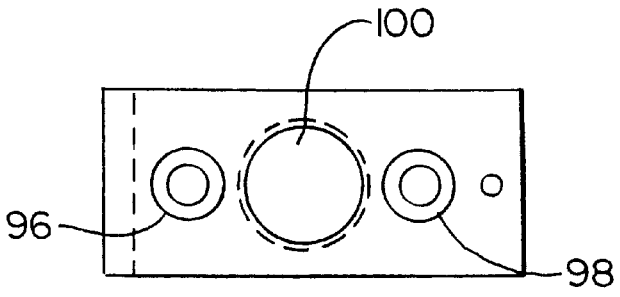
FIGS. 20A–C are various views of the take-up member.
Figure 20B:
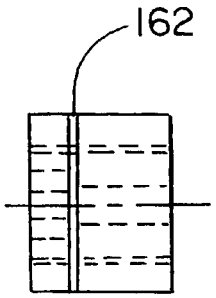
Figure 20C:
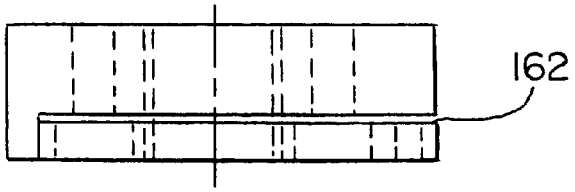

After setting of the zero position, a releasable lock in the form of a screw clamp 142 is then operated to lock the collar 112 onto the actuator shaft 90 so that subsequent rotations thereof rotate the collar 112 therewith. For this purpose, a transverse counter-bore 142 is formed in the collar portion 129 with the bore 142 spanning the slot spacing 140, as shown in FIG. 17B. The bore 142 includes an enlarged counter recess 144 in which a spacer 146 (FIG. 19) is held. The spacer 146 is preferably cylindrical to allow a threaded shaft (not shown) of the screw clamp 141 to extend therethrough and for being threaded to a small diameter tapped bore section 148 on the opposite side of the slot 140 relative to the bore opening 144.

Figure 18:
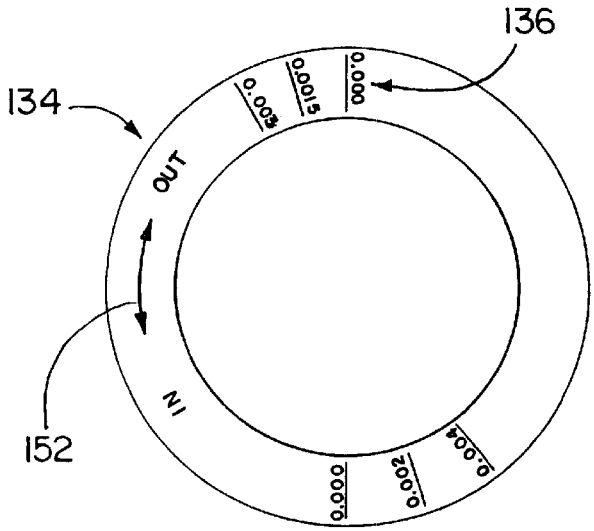
FIG. 18 is a elevational view of a mylar label including indicia that are to be aligned with the apertures of the collar with the label adhered thereto.

Accordingly, rotation of the screw clamp 141 via lever operating arm 150 thereof in a tightening direction causes the space provided by the slot 140 to be taken up or reduced with the surfaces of the collar bore 130 tightly engaged on the portion of the actuator shaft 90 extending therethrough. With the lock 141 in its locked condition, the collar 112 will now rotate with the shaft 90 as the operator turns the control knob 86 to incrementally adjust the position of the knife 24 relative to the anvil 26 away from the zero position. As shown in FIG. 18, the mylar label 134 can include arrow indicia 152 showing the operator which way to turn the knob to move the knife 24 toward or away from the anvil 26. As the operator turns the knob 86, they will also have lifted the plunger shaft 124 so that its lower end 124*a* clears the zero aperture 116*a* or 116*b*, as previously discussed.

Figure 14:
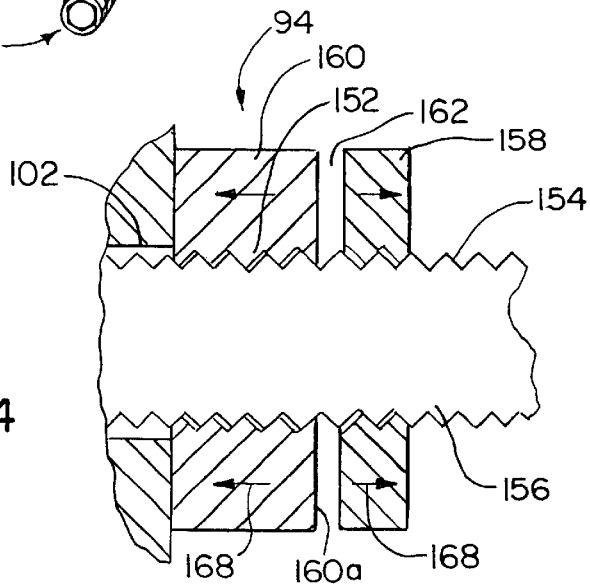
FIG. 14 is an enlarged fragmentary sectional view of the take-up member on the actuator shaft showing the threaded engagement therebetween with the take-up member adjusted to take up the slack in the threads.

As previously mentioned, the member 94 is fixed to the spindle block housing 48 at the rear end portion 84 thereof and it cooperates with the actuator shaft 90 to provide the screw drive system 89 for precision shifting of the knife 24. The bore 100 of the member 94 is provided with internal threads 152 that mate with external threads 154 on actuator shaft end 156, as best seen in FIG. 14. The shaft end 156 projects forwardly from the member 94 and into recessed bore 102 formed in the spindle block rear end portion 84, as previously described. As shown, the recessed bore 102 is formed with sufficient clearance so that the shaft end 156 can translate therein as the shaft 90 rotates.

One of the problems with utilizing a screw drive system for the precision shifting of the knife 24 is that with threads of a normal tolerance sizing, there will be play between the threads 152 and 154 that creates backlash after the knife 24 has been shifted to the desired gap spacing 37 with the anvil 26. This backlash is unacceptable for precision trim cutting as it causes the gap spacing 37 between the knife 24 and anvil 26 to change and can make the difference between a high and a low quality trim cut on the signatures 16. Normal tolerance on threads is of the order of a couple of thousandths of an inch. While that appears small, herein the knife 24 is to be incrementally moved between the various spaced predetermined positions on the order of 0.0015 inch or 0.002 inch, as previously described. Accordingly, the normal play for threads is not acceptable.

Thus, the member 94 is formed as a take-up member with adjustable portions 158 and 160 thereof each having the threads 152. These adjustable portions 158 and 160 are axially spaced from each other by a small gap 162 machined into the take-up member 94. This gap 162 is adjustable so as to allow the member 94 to take up the play between the threads 152 and 154.

More specifically, an adjustment member in the form of a threaded set screw 164 can be threaded through small threaded bore 166 in the member portion 158. To increase the gap size 162 thus placing the members 158 and 160 in tension as indicated by arrows 168 in FIG. 14, the adjustment screw 164 is threaded until its distal end 166 abuts against rearwardly facing wall 160*a* of the take-up member portion 160. Continued turning of the adjustment screw 164 pushes the portions 158 and 160 apart from each other widening the gap 162 and taking up the play in the threads 152 and 154. The amount of tension on the threads 152 and 154 can be fine-tuned so as to allow threads 152 and 154 to rotate relative to each other without seizing while still substantially eliminating the backlash problems associated with a normal loose tolerance sizing of the threads 152 and 154. In this way, the take-up member 94 herein avoids the need to provide precision ground threads and the high expense associated therewith while still providing for precision positioning of the knife 24 relative to the anvil 26 without the aforedescribed backlash problems.

The take-up member 94 can be of a softer material than the preferred hardened steel actuator shaft 90 such as brass so as to minimize seizing between the threads 152 and 154. With repeated usage the softer brass take-up member 94 may start to wear; however, the wear can be compensated for by simply tightening the set screw 164 to take-up any additional play in the threads 152 and 154 created by the wear of the take-up member material.

Figure 15:
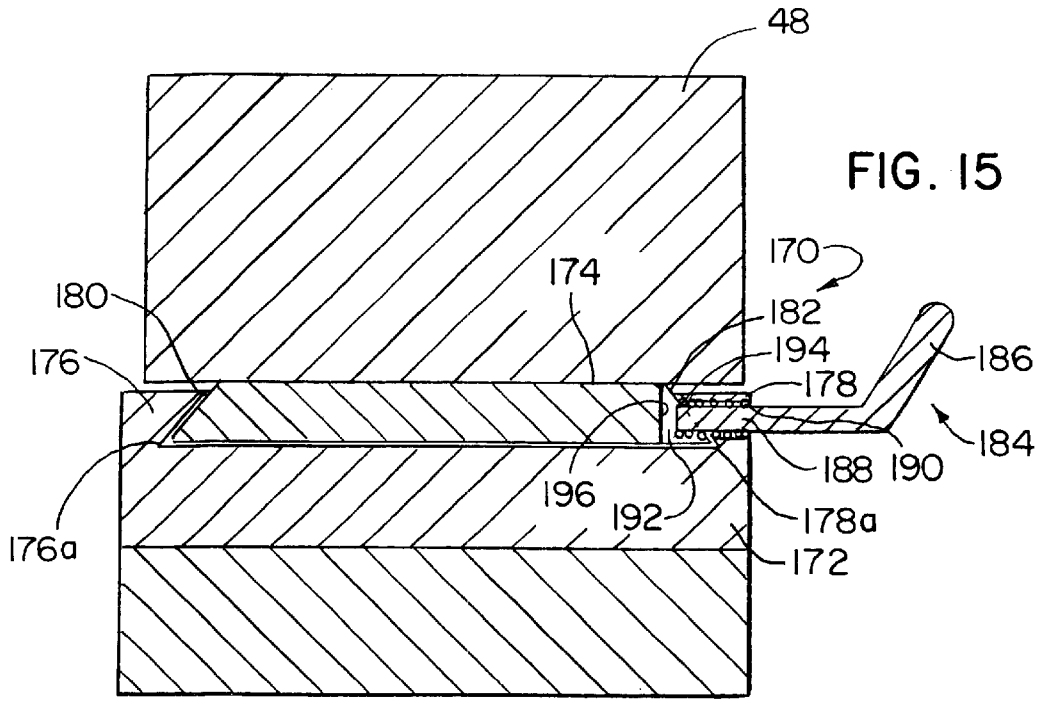
FIG. 15 is an enlarged cross-sectional view of the slidable mounting of the spindle block on a fixture base including the releasable locking clamp therefor.

Referring next to FIG. 15, there is shown the slide mounting of the spindle block 48 to allow it to undergo translation in the fore and aft direction 44 when the control knob 86 is turned. Slide mount 170 includes a base plate or fixture 172 and a gib portion 174 at the lower end of the spindle block 48. The fixture plate 172 and gib portion 174 can have a dovetail fit with each other. In this regard, the fixture plate 172 includes undercut side portions 176 and 178 on either side of the gib portion 174 which has inclined surfaces 180 and 182 in close confronting relation the facing surfaces 176*a* and 178*a* of the respective fixture plate side portions 176 and 178 to provide secure guiding of the spindle block 48 as it slides on the fixture plate 172.

Continuing reference to FIG. 15, a releasable lock in the form of a screw clamp 184 is provided for either locking the spindle block 48 in fixed position relative to the fixture plate 172 or releasing it for translation thereon as earlier described. The screw clamp 184 is similar to the index collar screw clamp 141 and includes an operating lever 186 for turning a threaded shaft 188 attached thereto. The fixture plate 172 has a threaded through bore 190 formed in the plate side portion 178 and in which the shaft is received with the bore 190 opening to a notched area 192 formed in the gib surface 182. The notched area 192 extends for a sufficient distance in the axial direction 44 to allow the necessary shifting of the spindle block 48 in that same direction.

As shown in FIG. 15, the screw clamp 184 is in its unlocked condition which allows an operator to turn the control knob 86 as they lift up on the plunger assembly knob 128. Once the plunger shaft 124 clicks into the aperture 116 corresponding to the desired knife/anvil spacing 37, the operator turns the operating lever 186 to advance the shaft 188 through the bore 190 until the distal shaft end 194 engages and presses against a flat surface 196 of the notched area 192. This pressing engagement of the shaft end 194 and surface 196 will tightly push the surfaces 176*a* and 180 of the fixture plate 172 and spindle block gib portion 174, respectively, against each other causing binding and locking the spindle block 48 against further axial movement in the direction 44 thus fixing the knife/anvil spacing 37 at the selected size.

Figure 8:
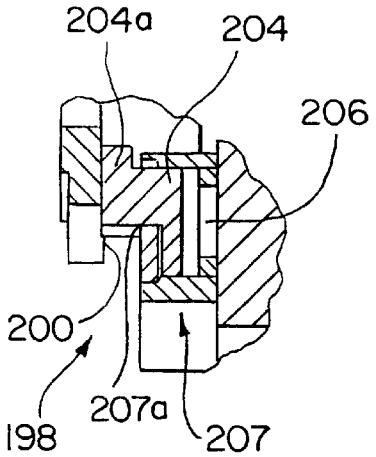
FIG. 8 is an enlarged fragmentary sectional view of a scraper mechanism for the anvil including a scraper that engages the anvil and a biasing member for the scraper to urge it into contact with the anvil.

Referring next to FIG. 8, a scraper mechanism 198 is shown for keeping the rotary anvil 26, and particularly the rear disk face 200 thereof, clean and free of debris that might collect thereon during cutting operations. It is this rear disk face 200 that cooperates with the cutting edges 42 or 62 of the rotary knives 24 or 25 to generate the scissors-like cutting action on the signatures 16. The disk face 200 projects radially out from the disk body 202 to provide sufficient clearance for the necessary vertical overlap between the cutting edges 42 or 62 and the disk face 200 for proper scissors cutting of the signature 16.

The scraper mechanism 198 is disposed at the lower end 204 of the anvil 26 opposite the upper end 36 thereof and remote from the cutting area 23. Debris such as ink, varnish and glue from the signatures may adhere to the disk face 200 such as due to the heat generated during cutting operations. This debris will cause an effective reduction in the size of the gap spacing 37 and can lead to premature wear of the knife edges 42 or 62. Accordingly, the scraper mechanism 198 is advantageous in that it maintains the set clearance gap 37 between the knife 24 or 25 and anvil 26.

More specifically, the scraper mechanism 198 can include a plastic scraper member 204 that is urged into engagement with the disk face 200 by way of biasing member 206. A housing 207 for the biasing member 206 has a side opening 207*a* through which a disk engaging portion 204*a* of the scraper member 204 extends. The biasing member can be in the form of a wave spring 206 that is effective to keep the plastic member 204 in scraping engagement with the disk face 200 even as the harder disk face 200, e.g. of tungsten carbide material, wears the engaging surface of the plastic scraper member 204 down. In this manner, the scraper mechanism 198 will scrape the disk face 200 clean over a large number of cycles of the rotary anvil 26 before the scraper member 204 needs to be replaced.

Figure 21:
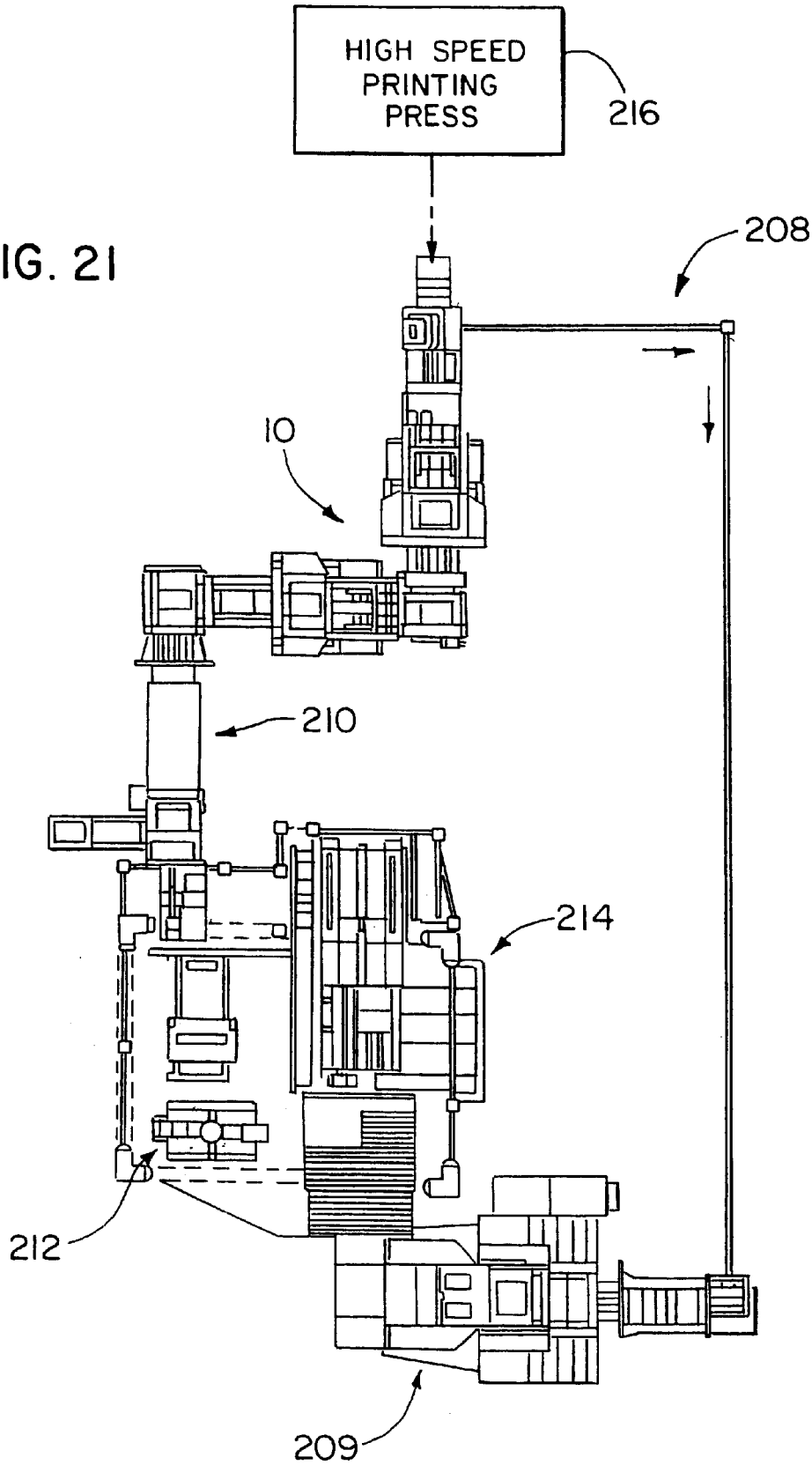
FIG. 21 is a schematic view of a layout for post-press in-line finishing equipment including the rotary trimmer apparatus that can incorporate the cutting apparatus of the present invention.

FIG. 21 is a schematic of a room layout in which the rotary trimmer apparatus 10 can be utilized. As shown, upstream from the trimmer apparatus 10, a high speed printing press 216 produces printed signatures which are subjected to other processing equipment such that the rotary trimmer apparatus 10 receives a shingled stream of signatures 16 that have not been diverted by an overhead conveyor 208 to a log stacker 209. The trimmer apparatus 10 trims the signatures 16 with the trimmed signatures then transported to a compensating stacker 210 for either automated or manual pickup. After strapping of the trimmed signatures, a log gripper 212 can take logs of these signatures to the stacker which then delivers them to a palletizer 214.

As is apparent, the rotary trimmer apparatus 10 is part of an integrated processing line for the signatures 16 post press. Accordingly, high speed operation of each of the pieces of equipment in the processing line is needed to obtain the maximum amount of throughput and allow the printing press to be run at its maximum operating speed. With the cutting apparatus 12 herein, the rotary trimmer apparatus 10 will be able to maximize the number of high quality of trim cuts of the signatures 16 it generates and thus achieve the maximum throughput of the rotary trimmer apparatus 10 for a maximum duration before knife maintenance is required. In addition, since the present apparatus 10 and method obviate the unknown variable associated with inexact operator setup of the gap spacing 37 between the knife 24 and anvil 26 as in prior setup techniques, more precise information will be developed as to the knife life based on known variables relating to the type of signatures 16 and operating speeds where the optimum gap spacing 37 for these variables is used. More exact knife life information is beneficial for many reasons such as allowing operators to know precisely when the knife 24 will be in need of maintenance so as not to start a press run with a knife 24 that is close to the end of its useful life.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

We claim:

1. A cutting apparatus for forming high quality, precision cuts of sheet material being transported at high speeds, the cutting apparatus comprising:

a rotary knife and an anvil axially spaced from each other for cooperating to cut the sheet material as the material is transported;

a rotary drive system for the knife for rotating the knife at predetermined high rotary speeds;

a knife spindle assembly for the knife including a rotary spindle shaft extending axially and to which the knife is mounted and which is driven for rotation by the drive system to rotate the knife therewith;

an adjustment mount for the spindle assembly that allows for precision axial shifting of the knife to one of a plurality of predetermined axially spaced positions relative to the anvil before operation of the drive system for providing a cutting action on the sheet material to be cut at the different axially spaced positions; and a temperature control system for the knife spindle assembly that keeps temperature of the shaft substantially constant during cutting operations for substantially maintaining the knife at the selected one of the predetermined spaced positions relative to the anvil during high speed operation of the knife so that quality of the cuts generated thereby are kept consistent for a maximized number of cuts.

2. The cutting apparatus of claim 1 wherein the knife spindle assembly includes bearings for supporting the spindle shaft for rotation, and the temperature control system directs a cooling medium into heat transfer relation with the spindle shaft so that heat generated in the bearings generally does not cause the shaft to thermally expand.

3. The cutting apparatus of claim 1 wherein the knife spindle assembly includes a spindle housing for the spindle shaft, and the temperature control system includes a cool air supply that directs cool air into the spindle housing to minimize thermal expansion of the shaft.

4. The cutting apparatus of claim 1 wherein the knife includes at least one peripheral cutting edge, and the cooling system directs cool air at the knife cutting edge for minimizing heat generation thereat during cutting operations.

5. The cutting apparatus of claim 1 wherein the adjustment mount includes a moveable spindle block carrying the spindle shaft, and a user operated control operable to translate the spindle block for precision shifting of the knife between the plurality of predetermined spaced positions.

6. The cutting apparatus of claim 1 wherein the anvil includes a scraper mechanism that keeps the anvil free of debris during cutting operations.

7. A rotary trimmer apparatus for trimming signatures, the rotary trimmer apparatus comprising:

a frame;

a conveyor mounted to the frame for transporting signatures thereon;

a rotary knife including at least one peripheral cutting edge for trimming the signature traveling on the conveyor;

an anvil mounted to the frame;

an adjustment mechanism for the knife mounted to the frame which allows spacing between the knife and anvil to be adjusted for providing a cutting action on the signatures;

a rotary spindle shaft mounting the knife for rotation therewith;

bearings that mount the spindle shaft for rotation; and a temperature control system to substantially keep the shaft from axially expanding and changing the spacing of the knife from the anvil during trimming operations due to heat generated in the bearings with rotary operation of the spindle shaft.

8. The rotary trimmer apparatus of claim 7 wherein the temperature control system includes a housing having a temperature controlled internal space in which the spindle shaft extends, and a source of cooling medium for allowing cooling medium to be being directed through the housing to keep the housing internal space at a substantially constant temperature during trimming operations.

9. The rotary trimmer apparatus of claim 8 wherein the cooling medium is cool air and the cooling medium source comprises an air separator including housing to which incoming air is fed at an intermediate temperature with the air being separated into a hot air flow at a temperature higher than the incoming intermediate temperature air and a cold air flow at a temperature lower than the incoming intermediate temperature for being fed to the spindle shaft housing.

10. The rotary trimmer apparatus of claim 8 wherein the cooling medium source is a cool air source, and an outlet for the cool air source disposed to direct cool air at the peripheral cutting edge of the knife.

11. The rotary trimmer apparatus of claim 10 wherein the cool air source is common to both the outlet and for supplying cool air to the spindle shaft housing.

12. The rotary trimmer apparatus of claim 7 wherein the adjustment mechanism comprises an indexer calibrated for fine adjustments of a preset position of the knife in predetermined increments with the temperature control system effective to substantially maintain the knife preset position against shifting therefrom during trimming operations.

13. A rotary trimmer apparatus for trimming edge portions of signatures, the rotary trimmer apparatus comprising:

a frame;

a conveyor mounted to the frame for transporting signatures in a downstream travel direction;

a rotary knife and anvil spaced from each other in a direction transverse to the travel direction for cooperating to cut the signatures traveling downstream on the conveyor; and a user operated control assembly for shifting the knife in the transverse direction in predetermined increments to a plurality of predetermined positions relative to the anvil to allow precision adjustment of the size of the space between the knife and anvil for providing a cutting action therewith.

14. The rotary trimmer apparatus of claim 13 wherein the user operated control assembly includes a control knob which is turned to provide ease in adjustment of the predetermined position of the knife.

15. The rotary trimmer apparatus of claim 13 wherein the control assembly includes a calibrated indexer that shifts the knife in different increments to provide for fine knife/anvil spacing size adjustments and coarser knife/anvil spacing size adjustments.

16. The rotary trimmer apparatus of claim 13 wherein the knife includes a rotary spindle shaft to which the knife is mounted for rotation therewith with the shaft generally being between the knife and the control assembly so that the control assembly and a user operating the control assembly are remote from the knife.

17. The rotary trimmer apparatus of claim 13 wherein the knife includes a rotary spindle shaft and a carrying block for the spindle, and the control assembly includes an actuator shaft attached to the carrying block for shifting the block and the knife therewith, and a take-up member threaded on the actuator shaft via threads of a predetermined loose tolerance sizing, the member having adjustable portions to allow slack in the thread sizing to be reduced from the loose tolerance sizing for precision shifting of the carrying block by the threaded actuator shaft.

18. The rotary trimmer apparatus of claim 13 wherein the control assembly includes an indexing mechanism that provides a user an indication that the knife is at one of the predetermined positions.

19. The rotary trimmer apparatus of claim 13 wherein the knife is mounted to a spindle shaft for rotation therewith, and a cooling system for the spindle shaft that minimizes thermal expansion of the shaft for maintaining the knife at one of the predetermined positions during trimming operations.

20. A rotary trimmer apparatus for trimming edge portions of signatures, the rotary trimmer apparatus comprising:

a frame;

a conveyor mounted to the frame for transporting signatures in a downstream travel direction;

a rotary knife and anvil spaced from each other in a direction transverse to the travel direction for cooperating to cut the signatures traveling downstream on the conveyor; and a user operated control assembly for shifting the knife in the transverse direction in predetermined increments to a plurality of predetermined positions relative to the anvil to allow precision adjustment of the size of the space between the knife and anvil for providing a cutting action therewith, wherein the control assembly includes an indexing mechanism that provides a user an indication that the knife is at one of the predetermined positions, and the indexing mechanism includes a plunger and cooperating apertures that correspond to each of the predetermined positions with the plunger seated therein.

* * * * *